US011840424B2

(12) United States Patent
Zhou

(10) Patent No.: US 11,840,424 B2
(45) Date of Patent: Dec. 12, 2023

(54) RUNNING SYSTEM FOR ELEVATOR, AND MULTI-CAR ELEVATOR RUNNING SYSTEM

(71) Applicant: HUNAN DAJU INFORMATION TECH CO LTD, Changsha (CN)

(72) Inventor: Libo Zhou, Changsha (CN)

(73) Assignee: HUNAN DAJU INFORMATION TECH CO LTD, Changsha (CN)

( * ) Notice: Subject to any disclaimer, the term of this patent is extended or adjusted under 35 U.S.C. 154(b) by 137 days.

(21) Appl. No.: 17/593,051

(22) PCT Filed: Mar. 6, 2020

(86) PCT No.: PCT/CN2020/078116
§ 371 (c)(1),
(2) Date: Sep. 7, 2021

(87) PCT Pub. No.: WO2020/177758
PCT Pub. Date: Sep. 10, 2020

(65) Prior Publication Data

US 2022/0185627 A1 Jun. 16, 2022

(30) Foreign Application Priority Data

Mar. 7, 2019 (CN) ..... 201910172657.9
Oct. 25, 2019 (CN) ..... 201911023262.9

(51) Int. Cl.
*B66B 5/18* (2006.01)
*B66B 1/06* (2006.01)
(Continued)

(52) U.S. Cl.
CPC ..... *B66B 5/18* (2013.01); *B66B 1/06* (2013.01); *B66B 5/26* (2013.01); *B66B 7/02* (2013.01); *B66B 11/0226* (2013.01); *B66B 11/04* (2013.01)

(58) Field of Classification Search
CPC ..... B66B 11/0476; B66B 11/0461; B66B 11/0469; B66B 9/003
See application file for complete search history.

(56) References Cited

U.S. PATENT DOCUMENTS 6,237,705 B1 * 5/2001 Nakatani ..... B66B 9/0815 180/8.2
9,856,111 B1 1/2018 Anderson et al.
(Continued)

FOREIGN PATENT DOCUMENTS

CN 2692115 Y 4/2005
CN 101973478 A 2/2011
(Continued)

OTHER PUBLICATIONS

Machine Translation of WO 2007/080626.*
(Continued)

*Primary Examiner* — Diem M Tran
(74) *Attorney, Agent, or Firm* — Schwegman Lundberg & Woessner, P.A.

(57) ABSTRACT

A running system for an elevator comprises a car, running rails, and a driving mechanism, the car is moved on the running rails by means of the driving mechanism, and the running system does not comprise a traction part. In a multi-car elevator running system; the running system is provided with a plurality of cars and at least two set of running rails, and each set of running rails can be used for the movement of the cars; the running system is further provided with at least one switching mechanism and driving mechanism, the car is moved on the running rails by means of the driving mechanism, different running rails are connected by means of the switching mechanism, and the car is switched to the different running rails by means of the switching mechanism.

16 Claims, 10 Drawing Sheets

(51) Int. Cl.

| | |
|---|---|
| ***B66B 5/26*** | (2006.01) |
| ***B66B 7/02*** | (2006.01) |
| ***B66B 11/02*** | (2006.01) |
| ***B66B 11/04*** | (2006.01) |

(56) References Cited

U.S. PATENT DOCUMENTS

| | | | | |
|---|---|---|---|---|
| 2001/0020429 | A1* | 9/2001 | Serrano | B61B 13/00 105/141 |
| 2019/0077637 | A1* | 3/2019 | Bhaskar | B66B 11/0438 |
| 2023/0060525 | A1* | 3/2023 | Bergman | B66B 11/0453 |

FOREIGN PATENT DOCUMENTS

| | | | | |
|---|---|---|---|---|
| CN | 203922382 | U | 11/2014 | |
| CN | 109422161 | A | 3/2019 | |
| CN | 110155826 | A | 8/2019 | |
| CN | 110817645 | A | 2/2020 | |
| JP | 2008230790 | A | 10/2008 | |
| TW | WO-2020177758 | A1 | 9/2020 | |
| WO | WO-2007080626 | A1 * | 7/2007 | B66B 5/22 |

OTHER PUBLICATIONS

"International Application No. PCT/CN2020/078116, International Search Report and Written Opinion dated May 14, 2020", (dated May 14, 2020), 12 pgs.

* cited by examiner

RUNNING SYSTEM FOR ELEVATOR, AND MULTI-CAR ELEVATOR RUNNING SYSTEM

PRIORITY CLAIM TO RELATED APPLICATIONS

This application is a U.S. national stage filing under 35 U.S.C. § 371 from International Application No. PCT/CN2020/078116, filed on 6 Mar. 2020, and published as WO2020/177758 on 10 Sep. 2020, which claims the benefit under 35 U.S.C. 119 to Chinese Application No. 201910172657.9, filed on 7 Mar. 2019, and to Chinese Application No. 201911023262.9, filed on 25 Oct. 2019, the benefit of priority of each of which is claimed herein, and which applications and publication are hereby incorporated herein by reference in their entirety.

BACKGROUND OF THE INVENTION

1. Technical Field

The present invention relates to elevator structure technology, and more particularly to a running system for elevator and multi-car elevator running system

2. Description of Related Art

In modern society and economy, the elevator has turned out to be an indispensable vertical transportation means for carrying people or loads. According to statistics, the average annual growth rate of the demand for elevators is more than 20% in China, which has become the world's largest elevator market. However, foreign brands such as Otis, Schindler, Kone, Thyssen Krupp, Mitsubishi and Hitachi share 70% of the elevator market in China, while national brands share very small share of the market. Elevators of national brands lag far behind the brands from developed countries in terms of technology and after-sales service; moreover, the blockade on some key technologies by foreign manufacturers seriously hampers the development of elevator industry in China. Enhancing the technology innovation capabilities of the elevator industry, breaking the technological monopoly of foreign manufacturers, and increasing the market share of national elevator brands have turned into a problem demanding prompt solution.

Since the invention of elevator in 1854, elevator cars have been operated with wire rope wheel traction, which usually allows only one car to run in a shaft; elevators in single-car operation mode can still meet the operational requirements in low-rise buildings and on low-traffic floors. With the rapid development of modern cities, high-rise buildings and super high-rise buildings with high population densities mushroom quickly; as a result, the shortcomings of elevators in single-car operation mode such as long wait time and low transportation efficiency have been increasingly obvious; it's difficult for such traditional single-car elevator operation mode to adapt to the requirements of the fast-growing modern urban buildings.

In the wire rope traction mode, wire ropes are driven to pull the cars and counterweights to run on the rails in shafts by setting up machine rooms, traction motors and governor on top floors of buildings. Traction machine is used with safety gear for the braking of wire rope traction elevators; the braking of traction machine is realized by circuit control; in the event of elevators running over speed, the power supply circuit is switched off to stop the traction machine. When the traction machine brake malfunctions, the elevator runs downward; the speed limiter grasps the wire rope to force the safety gear to operate, thereby forcing the elevator to stop on the guide rail.

With operation of the elevator, the above-noted braking with wire rope traction is associated with such risks as severe wear, slippage and breakage of wire ropes; the more frequent the braking, the greater the impact on the wire ropes, and the lower their service life; moreover, the wire ropes need to be regularly lubricated and replaced, which brings about high costs. Where the severely worn wire ropes fail to be replaced in time, the brake system may fail to stop the car.

With the progressive evolution of engineering technologies, hydraulically driven elevators and screw column elevators have been invented. After expiry of the service life of cylinder pistons for hydraulically driven elevator, they are prone to wear or breakage, which may lead to hydraulic oil leakage and bring about contamination; moreover, their poor maintainability is also a problem. Due to their own structural limitations, screw column elevators are principally used for villas and cannot be installed in high-rise buildings; moreover, they are also disturbed by such shortcomings as slow speed and high noise.

SUMMARY OF THE INVENTION

To address the technical issues left unsolved by the prior art, the present invention provides a running system for elevator and a running system for multi-car elevator, which running system enhances the operational safety of elevators and enables the high-speed operation of cars to meet the speed requirements for high-rise elevators.

To address the foregoing technical issues, the present invention provides a technical scheme, wherein: a running system for elevator, which includes car, guide rail and driving mechanism; the car moves on the guide rail through the driving mechanism, the friction develops between the driving mechanism and guide rail; the friction is the driving force for car, the driving mechanism is designed with a climbing module that clings to the guide rail; the car runs on the guide rail through the climbing module.

As further improvements on the foregoing technical scheme:

The climbing module includes a pressure assembly and at least one set of attaching assemblies, which move on the guide rail and are pressed against the guide rail through the pressure assembly.

The sliding friction that forces the car to run develops between the attaching assembly and guide rail.

The attaching assembly rolls on the guide rail.

The friction F between the attaching assembly and guide rail satisfies the following formula:

$$F=G+ma$$

Where, G represents car weight; m denotes car mass; a stands for car acceleration.

The attaching assembly moves on the guide rail, and the friction coefficient f between the guide rail and attaching assembly is greater than 0.4.

The pressure applied by the pressure assembly on the attaching assembly is at least F/f, where F represents the friction between attaching assembly and guide rail.

The attaching assembly is made of rubber, which can be solid rubber.

The attaching assembly can be fitted with a round rolling component.

The attaching assembly can be a tire.

In an alternative proposal, the attaching assembly can also be provided with a non-circular part for rolling on the guide rail.

The attaching assembly can be a crawler.

The attaching assembly includes a driving part and at least two running parts; the running parts move on the guide rail, and the driving part drives the running parts through a rotating shaft.

The pressure assembly changes the rolling friction between running part and guide rail through the rotating shaft.

The running parts are furnished with limit parts.

At least two the guide rails are arranged, and each the guide rail corresponds to a running part, which is driven via the rotating shaft; each the running part is designed with a pressure part; the pressure between the running part and guide rail is increased/reduced through the extension or contraction of pressure part.

At least two the guide rails are arranged, and each the guide rail corresponds to two running parts; the two running parts on the same guide rail are driven through different rotating shafts, and correspond to a pressure assembly.

The running system is furnished with a brake mechanism, by means of which, the car stops moving or slows down.

The running system is furnished with a braking rail, which is the guide rail itself; or alternatively, the braking rail is separately arranged and does not intersect with the guide rail.

The brake mechanism is provided with at least one set of brake devices that are mounted on the car; the brake devices clamp the guide rail when in operation; the brake devices are not in contact with the braking rails during normal functioning of the car.

The brake mechanism is equipped with at least one set of self-lock devices, which are mounted on the car; where the brake device malfunctions or the car does not move, the self-lock device locks on the braking rail.

The braking rail is furnished with at least one lock piece, which is connected with the self-lock device when the self-lock device is in use.

The brake device is designed with a clamping component, which releases the braking rail when the car functions properly, and clamps the braking rail when the brake device works.

The driving mechanism is furnished with a position adjustment assembly for regulating the car balance.

The present invention also proposes a multi-car elevator running system; the running system is designed with a plurality of cars and at least two sets of guide rails, and each the set of guide rail is available for car movement; the running system is furnished with at least one switching mechanism and above-noted driving mechanism; the car moves on the guide rails through the driving mechanism; the guide rails are linked up via the switching mechanism; the guide rails of the car are changed through the switching mechanism.

The running system is designed with above-noted brake mechanism.

The switching mechanism includes rotating component and switching rail; the switching rail is connected to or disconnected from the two guide rails through the rotation of the rotating component.

The driving mechanism is provided with a control system, which includes the electrically connected monitoring module and processing module;

the monitoring module is used to monitor the car service data and transfer the data to the processing module;

the processing module sends commands to the pressure assembly based on the data acquired by the monitoring module.

The monitoring module is used to monitor the weight, velocity and balance of car.

The running system for elevator and the multi-car elevator running system has the following superiorities when compared with prior art:

(1) The running system is applicable to all elevators, and even those without traction component in the elevator system; it's extensively applicable for any elevator system. The upward and downward motion of car is realized through the friction between the attaching assembly and guide rail by using a motor to drive the attaching assembly clinging to the linear guide rail arranged within the elevator shaft.

(2) The driving mechanism is highly safe since there is no risk of elevator traction rope failure; the driving mechanism features low operating noise and vibration.

(3) The driving mechanism enables high-speed operation of the car, and thus meets the speed requirements for high-rise elevators; several cars are allowed to run in a shaft simultaneously, which solves the problem that conventional elevators can only run with one car in each shaft.

(4) The brake mechanism makes it unnecessary to provide car with traction component, which helps reduce the elevator system structure, thereby reducing the costs and shortening the period of engineering construction.

(5) The brake mechanism is easy to control, thanks to the simple drive for brake device, and offers braking performance; additionally, the mechanism is robust & durable and simple to maintain; the self-lock device is favorably reliable and highly safe.

LIST OF REFERENCE NUMBERS IN THE DRAWINGS

1. guide rail; 11. guide track; 12. rail brake; 13. skewed-tooth rail; 2. car system; 21. car; 22. guide wheel; 23. car body; 24. stand; 25. balancing apparatus; 3. brake device; 31. electric cylinder; 32. linkage; 33. clamping component; 33-1. mounting base; 33-2. clamping piece I; 33-3. friction block; 33-4 clamping piece II; 33-5. linkage I; 33-6. slide; 33-7. linkage III; 33-8. guide holder I; 33-9. guide holder II;

4. self-lock device; 41. self-lock piece; 42. connecting rod I; 43. moving block; 44. connecting rod II; 45. push rod; 46. stop pin; 5. running part; 51. hydraulic cylinder; 52. hydraulic pump; 53. motor; 54. reducer; 55. pressure rod; 56. hydraulic part; 6. wheel flange; 61. rotating shaft; 7. switching rail; 71. Turnout; 8. processor; 9. braking rail.

DETAILED DESCRIPTION OF THE INVENTION

The specific embodiments are described in detail below with reference to the accompanying drawings. It should be noted that the specific embodiments described here are only used to illustrate and explain the present invention, but not to limit the present invention.

Embodiment 1

Figure 1:
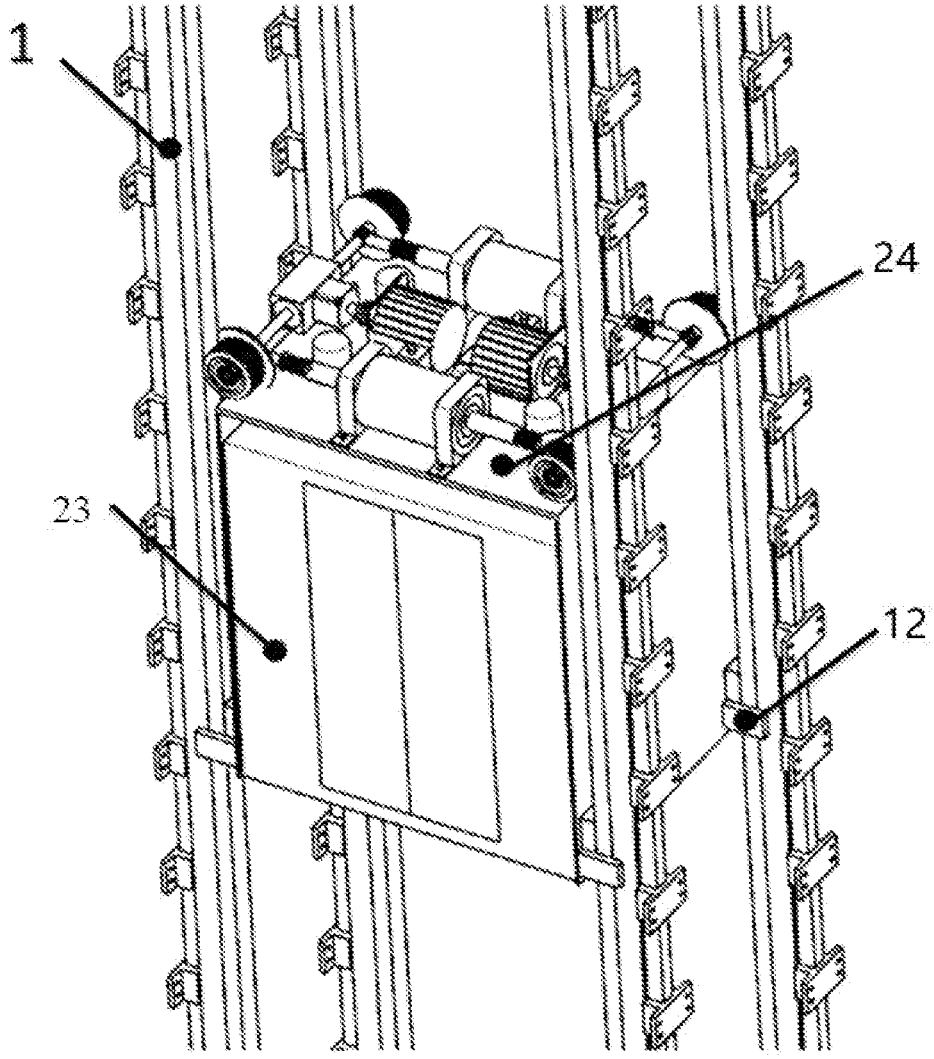
FIG. 1 is a schematic structural view of the driving mechanism.
Figure 2:
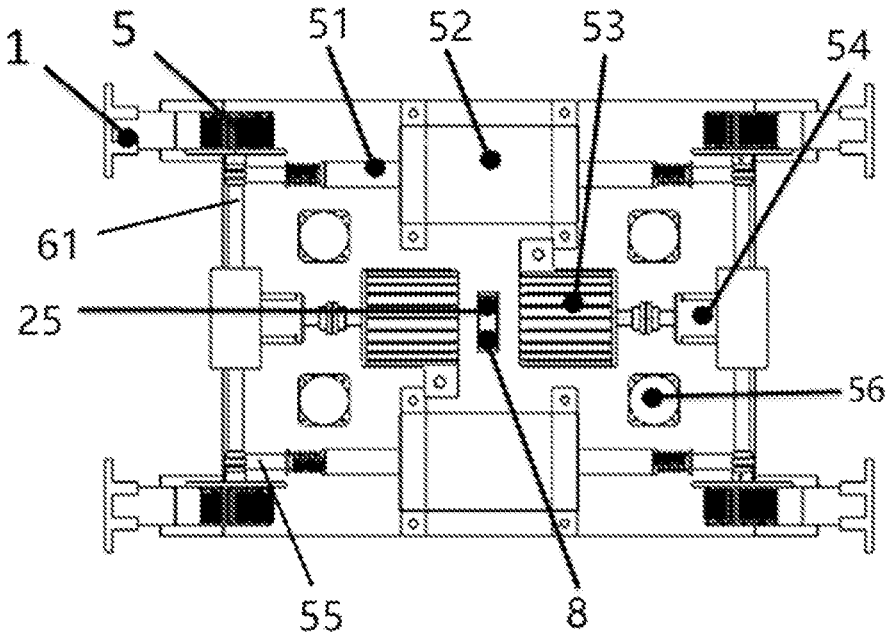
FIG. 2 is a schematic structural view of Embodiment 1.

FIG. 1 and FIG. 2 illustrate an embodiment used for the running system for elevator; the running system for elevator includes car 21, guide rail 1 and the driving mechanism; car 21 is driven by the driving mechanism to move up or down on the guide rail; the running system may not be provided with the traction component that is frequently used in prior art, that is, no wire rope traction is arranged.

In this embodiment, the running system is designed with a shaft that accommodates guide rail 1; car 21 moves up and down in the shaft. Car 21 includes car body 23 and stand 24, and car body 23 is mounted in stand 24; the driving mechanism is furnished with a climbing module, which includes a pressure assembly and at least one set of attaching assemblies; the attaching assemblies are mounted on stand 24; car body 23 is designed to carry passengers; attaching assemblies move on the guide rail, and cling to guide rail 1 through pressure assembly.

In this embodiment, each shaft is designed with 4 guide rails 1. Car 21 runs on guide rail 1 through the driving mechanism. Guide rail 1 is made of steel; there are two sets of attaching assemblies, and each set includes a driving part and two running parts 5, which are made of solid rubber; this embodiment employs rubber tires, each of which is connected to the driving part via rotating shaft 61. The driving part is motor 53, and the attaching assembly is designed with reducer 54; motor 53 and reducer 54 are bolted onto stand 24. Motor 53 drives the two rotating shafts 61 to rotate via reducer 54, thereby driving the tires to rotate; the four tires fit tightly to the four guide rails 1 arranged in the shaft, respectively; guide rail 1 of the shaft is fixed to the wall.

In the present embodiment, there are two sets of pressure assemblies, which are hydraulic assemblies; each set of pressure assemblies include a thrust part and two pressure parts; the thrust part is hydraulic pump 52, while the pressure part is composed of hydraulic cylinder 51 and pressure rod 55; pressure rod 55 is connected with rotating shaft 61, and a universal joint is arranged between pressure rod 55 and rotating shaft 61 so that the pressure assembly can exert pressure on tires when reducer 54 and motor 53 are in a fixed state; as a result, the tires have enough friction to move on guide rail 1 to drive the car up and down. Hydraulic cylinders 51 at both ends of hydraulic pump 52 are connected to the two rotating shafts 61 at opposite rotation speeds. Hydraulic pump 7 drives hydraulic cylinder 51 and pressure rod 55 to extend or contract; the extension/contraction of pressure rod 55 increases/reduces the pressure on rotating shaft 61 to ensure the safe operation of car.

In the present embodiment, the solid tires are made of cellular polyurethane elastomer. Raw materials for the synthesis of microporous elastomer include polyol, diisocyanate, chain extender, catalyst, foaming agent, foam stabilizer, and other additives. Other additives include fire retardant, antioxidant, colorant, etc. Solid tires made of cellular polyurethane elastomer are classified into non-reinforced and reinforced tires; non-reinforced tires are light-duty tires, while reinforced tires are heavy-duty tires. Heavy-duty solid tires composed of elastomer, reinforcer and bead wire are used for the present embodiment. The min. accumulated fit width between outer surface of tire and the guide rail is 145 mm. The tire surface is designed with non-skid patterns.

In the present embodiment, wheel flange 6 is arranged at the inner side of tire and fits to guide rail 1; the wheel flange guides the motion of the tire on guide rail 1, and restricts the lateral displacement of the car.

The dry friction coefficient between rubber and steel is as follows:

the static friction coefficient is 0.8-0.9.

Under normal circumstances, the passenger car weighs approx. 2t, and its max. acceleration is 1 $m/s^2$. According to the design of existing running system for elevator, the shaft width is 2 m*2 m, and guide rail 1 is 200 mm in width; the min. distance between adjacent guide rails in the same shaft is 860 mm, and the min distance between guide rails 1 in adjacent shafts is 1,940 mm; therefore, the tire should be narrower than guide rail 1; to ensure the friction, based on the fact that the structural strength should meet the safety requirements, the min accumulated fit width between the outer surface of tire and guide rail 1 should be 145 mm, and the tire diameter should be 300 mm. Then, the friction of the wall against the tire (theoretically, that's the friction between guide rail 1 and the tire) is $$F=G+ma$$

Where,

G=20000 N m=2000 kg a=1 $m/s^2$

So, F=22000 N

The friction needs to be greater than the car weight and inertia force; friction coefficient 0.8 is taken as an example for calculation, and the min pressure that the pressure assembly needs to exert on the tire with safety guaranteed is:

$$F_{pressure}=22000\div0.8=27500\text{ N}$$

Then, each tire is subjected to a pressure of 6,875 N. The hydraulic parts of prior art for sale on the market can absolutely meet this requirement on pressure.

In the present embodiment, the driving mechanism is also furnished with a position adjustment assembly, which is provided with 4 hydraulic parts 56 and one balancing apparatus 25 to preserve the car balance. Hydraulic part 56 comprises hydraulic cylinder 51 with adjustable stroke and hydraulic pump 52.

In the present embodiment, the running system is also designed with a brake mechanism that can incorporate brakes commonly used in elevator systems in the prior art; or alternatively, the brake mechanism can be the one used in Embodiments 4 or 5.

Where brakes commonly used in elevator systems in the prior art are employed, rail brake 12 is used; the bottom of stand 24 is furnished with two pairs of rail brakes 12, which impose constraints on car 21 when in operation, so that the car will not shake. Once the monitoring module detects a safety problem in car 21 (e.g., a car speed that is beyond the rated speed, or a car acceleration that is more than 1.2 times the rated acceleration), rail brake 12 will restrain guide rail 1 for emergency braking of the car.

In the present embodiment, the driving mechanism is provided with a control system, which includes the electrically connected monitoring module and processing module. The monitoring module is designed to monitor and transfer the car service data to the processing module; the processing module sends commands to the pressure assembly based on the data acquired by the monitoring module. The monitoring module is used to monitor the weight, velocity and balance of car. The processing module is processor 8, and the monitoring module includes the weight sensor, the velocity sensor, and balancing apparatus 25 mounted at the car.

If differential speed exists in drive for the tire, car body 23 may tilt slightly in the horizontal direction; balancing apparatus 25 will determine the tilt angle of car body 23, and sends the data to processor 8, which controls the 4 hydraulic parts 56 of position adjustment assembly to extend or contract the hydraulic cylinder of hydraulic part 56, thereby regulating the relative angular position between stand 24 and car body 23; in that way, the car remains stable and upright all the time, which helps improve the comfort of elevator passengers.

Embodiment 2

Figure 3:
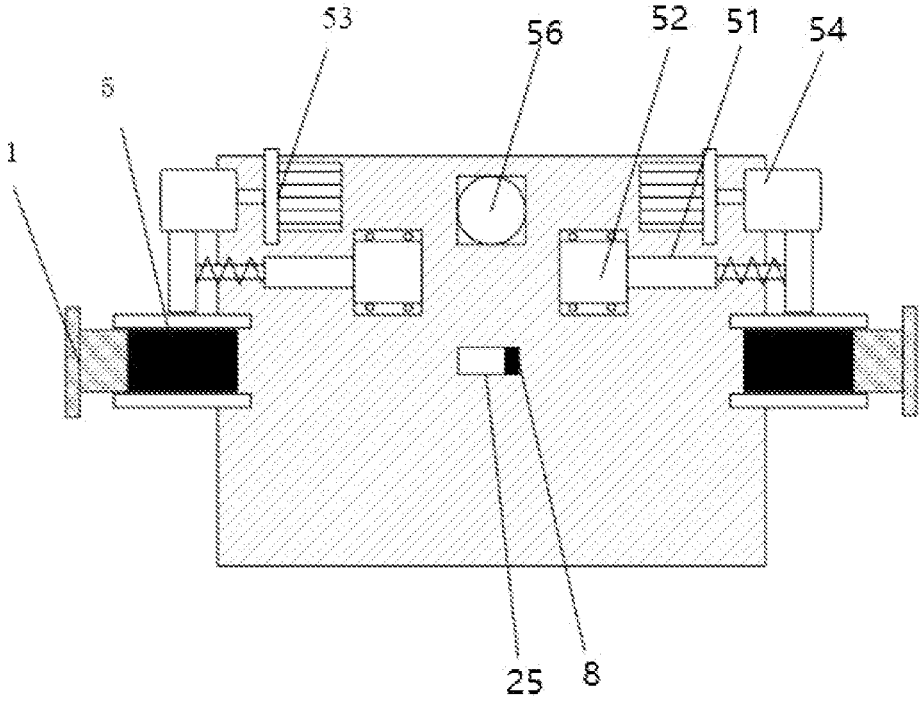
FIG. 3 is a schematic structural view of Embodiment 2.

FIG. 3 illustrates the second embodiment for its application in the running system for elevator. The principal difference between this embodiment and Embodiment 1: A shaft is designed with two guide rails 1, and there are two corresponding tires, which are closely attached to guide rail 1, respectively. Wheel flanges 6 are arranged on both sides of each tire, and each tire is equipped with a driving part and a set of pressure assemblies; both pressure assemblies simultaneously apply pressure to the corresponding tires so that they gain enough friction to drive the car up or down.

Embodiment 3

Figure 4:
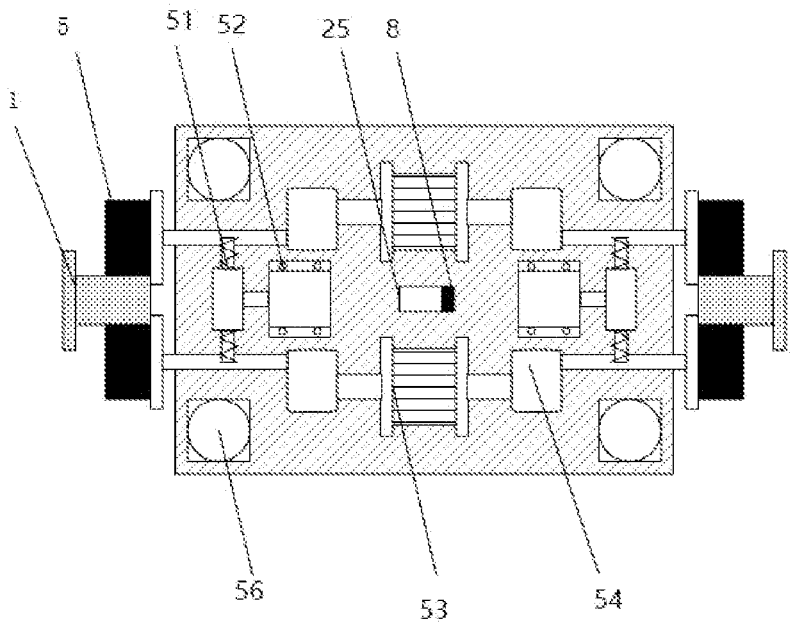
FIG. 4 is a schematic structural view of Embodiment 3.

FIG. 4 illustrates the third embodiment for its application in the running system for elevator. The principal difference between this embodiment and Embodiment 1: A shaft is designed with two guide rails 1, and there are four tires; two tires are closely attached to guide rail 1, while the other two guide rails 1 are located in the middle on both sides of the car. There are two sets of pressure assemblies, of which each are respectively connected to rotating shafts 61 of the two tires on the same side. The pressure assemblies provide sufficient pull to the two rubber tires. The driving part drives the two tries to rotate towards each other simultaneously to drive the car up or down. The forces of the two tires on guide rail 1 cancel each other out, which dramatically reduces the force on the wall.

In the present embodiment, wheel flange 6 is arranged at the inner side of tire to guide the motion of the tire on guide rail 1, restricting the lateral displacement of the car.

Embodiment 4

Figure 5:
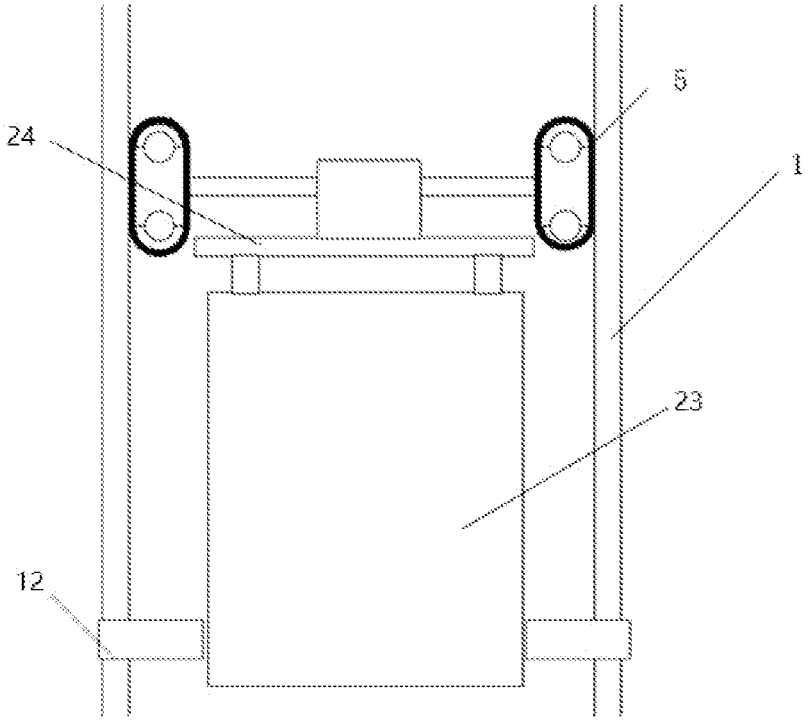
FIG. 5 is a schematic structural view of Embodiment 4.

FIG. 5 illustrates the fourth embodiment for its application in the driving mechanism of the running system for elevator. The principal difference between this embodiment and Embodiment 1: Running part 5 of the present embodiment employs rubber crawler. The rubber crawler is closely attached to guide rail 1. Each set of rubber crawlers are furnished with a set of pressure assemblies, so that they gain enough friction to drive the car up or down.

The driving mechanism designed for the running system for elevator offers a new type of elevator drive; no machine room is needed when compared with traditional traction-type elevators. Besides, it's easy to realize the multi-car operation in a single shaft, which helps remarkably improve the operating efficiency of elevators. Furthermore, the number of guide rails 1 in the shaft and the tire matching method can be changed with practical situation; the pressure assembly is designed to exert pressure on the tire through motor-driven pull rod or electromagnetically. All such obvious changes are intended to adapt to the operation of elevator in the shaft and the minor adjustments and changes made within the scope of this patent.

Embodiment 5

Figure 6:
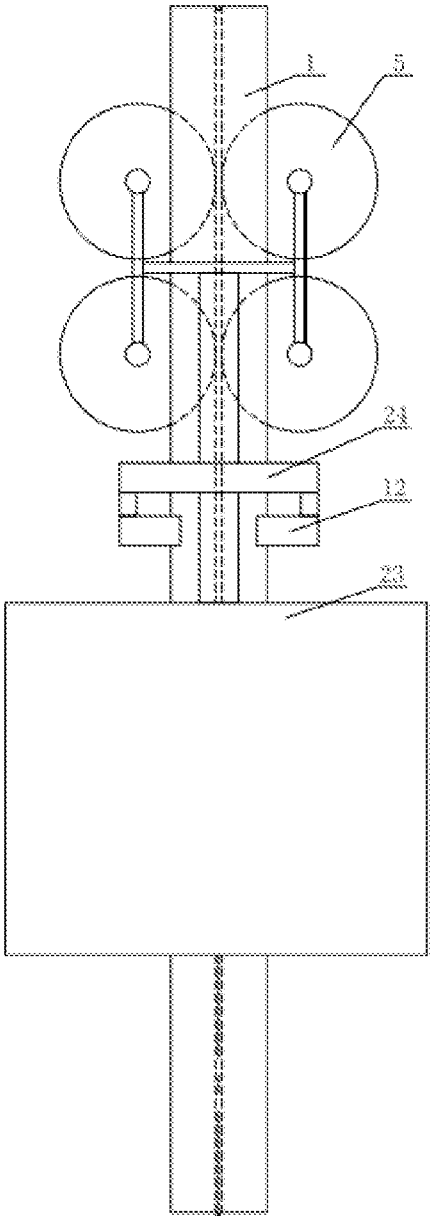
FIG. 6 is a schematic structural view of Embodiment 5.

FIG. 6 illustrates the fifth embodiment for its application in the driving mechanism of the running system for elevator. The principal difference between this embodiment and Embodiment 1: Running part 5 of the present embodiment is a solid tire, and a single guide rail is arranged at the rear of the system. The solid tire tightly clings to guide rail 1. The solid tire is furnished with a set of pressure assemblies, so that they gain enough friction to drive the car up or down.

The driving mechanism designed for the running system for elevator offers a new type of elevator drive; no machine room is needed when compared with traditional traction-type elevators. Besides, it's easy to realize the multi-car operation in a single shaft, which helps remarkably improve the operating efficiency of elevators. Furthermore, the number of guide rails 1 in the shaft and the tire matching method can be changed with practical situation; the pressure assembly is designed to exert pressure on the tire through motor-driven pull rod or electromagnetically; or alternatively, pressure can be exerted directly through elastic components. All such obvious changes are intended to adapt to the operation of elevator in the shaft and the minor adjustments and changes made within the scope.

Embodiment 6

Figure 7:
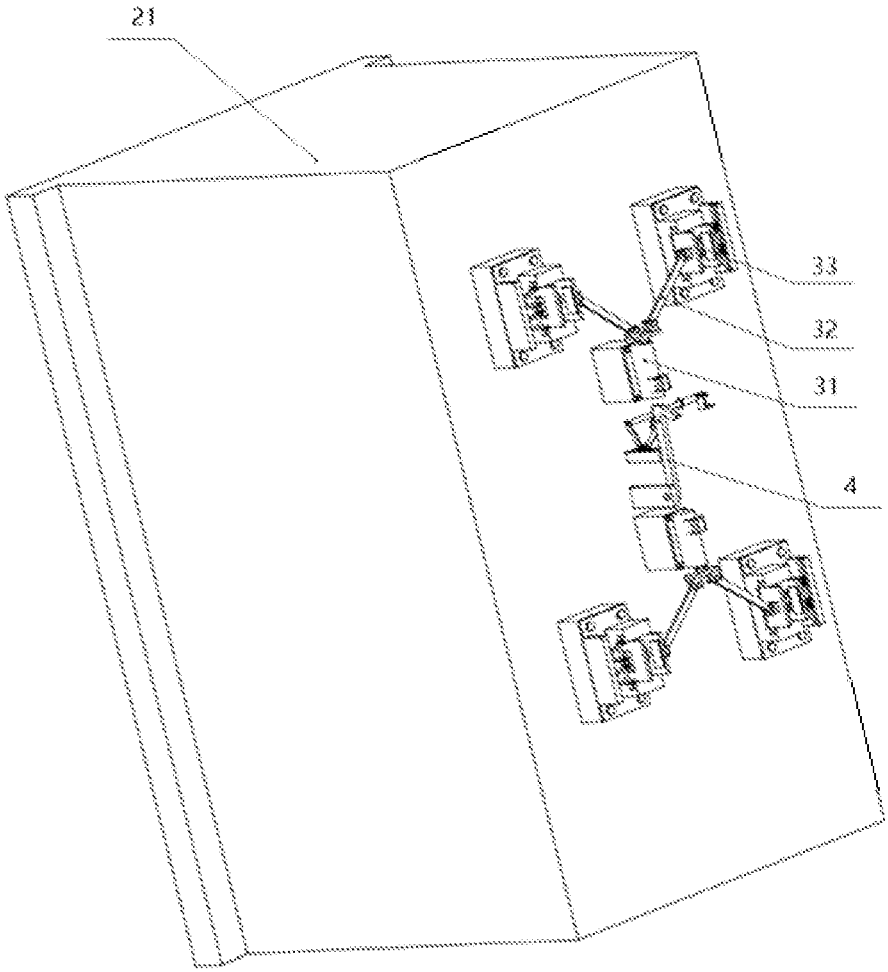
FIG. 7 is a schematic structural view of Embodiment 6 "brake mechanism".
Figure 11:
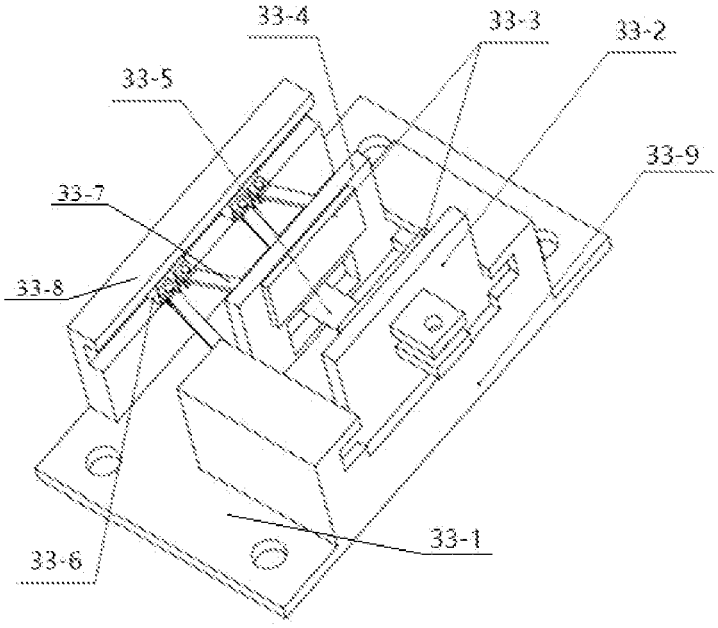
FIG. 11 is a schematic structural view of brake device under the present invention.
Figure 12:
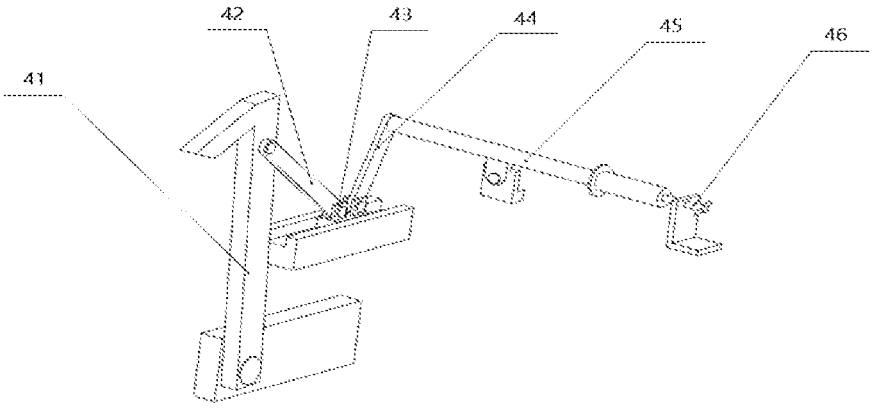
FIG. 12 is a schematic structural view of self-lock device under the present invention.

FIG. 7, FIG. 11 and FIG. 12 illustrate an embodiment of the brake mechanism in the running system. The running system is designed with a brake mechanism, and the elevator is fitted with car system 2 and guide rail 1; car 21 moves up or down on guide rail 1; the brake mechanism includes brake device 3 and self-lock device 4; there is at least one set of brake devices 3. In the present embodiment, the braking rail is equipped with two rigid braking rails 9 and skewed-tooth rail 13 that prevents car 21 from falling; all rails are arranged in the shaft; braking rail 9 and skewed-tooth rail 13 are installed on several longitudinally arranged supporting beams that are fastened in the shaft.

In the present embodiment, brake device 3 is mounted on car 21; there are four sets of brake devices 3 arranged in two rows at the four corners of car 21, respectively; each brake device 3 is the same minimum distance away from the edge of car 21; brake devices are symmetrically arranged. The driving part for brake device is electric cylinder 31, and there are 2 electric cylinders 31. Brake device 3 is furnished with clamping component 33, which includes mounting base 33-1 and two clamping pieces; clamping piece I 33-2 is hinged to the piston rod of electric cylinder 31, and clamping piece II 33-4 is installed on mounting base 33-1.

In the present embodiment, clamping component 3 also includes a guide assembly, which includes a sliding assembly and two guide holders; the guide holders are fastened to the mounting base. Clamping piece II 33-4 is designed with a through hole; the sliding assembly is provided with a linkage assembly and two slides; slide 33-6 is arranged in the groove of guide holder I 33-8 in a sliding manner. The linkage assembly includes linkage I 33-5 and linkage set II; one end of linkage I 33-5 is securely connected to clamping piece I 33-2, while the other end passes through the through hole and gets hinged to linkage set II. Linkage set II is provided with two sets of rotating linkages; each set of rotating linkages are furnished with two linkages III 33-7 in a V-shaped arrangement; one end of linkage III 33-7 is hinged to linkage I, and the other end is hinged to slide 33-6. Guide holder II 33-9 is designed with two guide slots; clamping piece II 33-4 is fixed to guide holder II 33-9; each end of clamping piece I 33-2 are designed with a bulge that slides in the guide slot. Clamping piece I 33-2 and clamping piece II 33-4 are fitted with friction block 33-3. During the braking, clamping piece I 33-2 is driven by electric cylinder 31 to approach clamping piece II 33-4 along the guide slot so as to clamp braking rail 9; in this process, two slides 33-6 slide sideways to impose a locking effect on the clamping of both clamping pieces. Clamping piece I 33-2 must be driven by electric cylinder 31 away from clamping piece II 33-4.

In the present embodiment, self-lock device 4 includes self-lock part 41, mounting block, and driving assembly; there are two mounting blocks, which are permanently connected to car 21; the self-lock part and driving assembly are mounted on the car through different mounting blocks. One end of self-lock part 41 is hinged to the mounting block, and the other end is equipped with a locking hook.

The driving assembly includes push rod 45, moving block 43 and connecting rod 42; moving block 43 is arranged in the groove of mounting block in a sliding manner, and the middle of push rod is hinged to car 21. There are two connecting rods; one end of connecting rod I 42 is hinged to self-lock part 41, and the other end is hinged to moving block 43; one end of connecting rod II 44 is hinged to moving block 43, while the other end is hinged to push rod 45.

In the present embodiment, the self-lock device also includes stop block and stop pin 46; the stop block is fastened to car 21, and stop pin 46 passes through the hole in stop block; one end of push rod 45 is hinged to connecting rod II 44, and the other end is removably connected to stop pin 46.

In the present embodiment, stop pin 46 is permanently connected to the stop block. Push rod 45 is driven by a driving part to get into or away from the stop pin. Electric cylinders, pneumatic cylinders, etc. can serve as driving parts; all dynamic sources in prior art that enable the push rod to move can be used as driving parts. After getting away from stop pin 46, push rod 45 is driven by the driving part to rotate about the central hinge point to push moving block 43 to slide, and then to drive self-lock part 41 to rotate through connecting rod I 42.

In the present embodiment, the lock piece is skewed-tooth rail 13, which is provided with skewed teeth.

When brake device 3 fails, car 21 falls to drive push rod 45 so that the locking hook of self-lock part 41 fits into skewed-tooth rail 13; that is, the hooked tooth fits skewed-tooth rail 13 on the braking rail to lock the car on the rail, thereby guaranteeing passenger safety.

Embodiment 7

Figure 8:
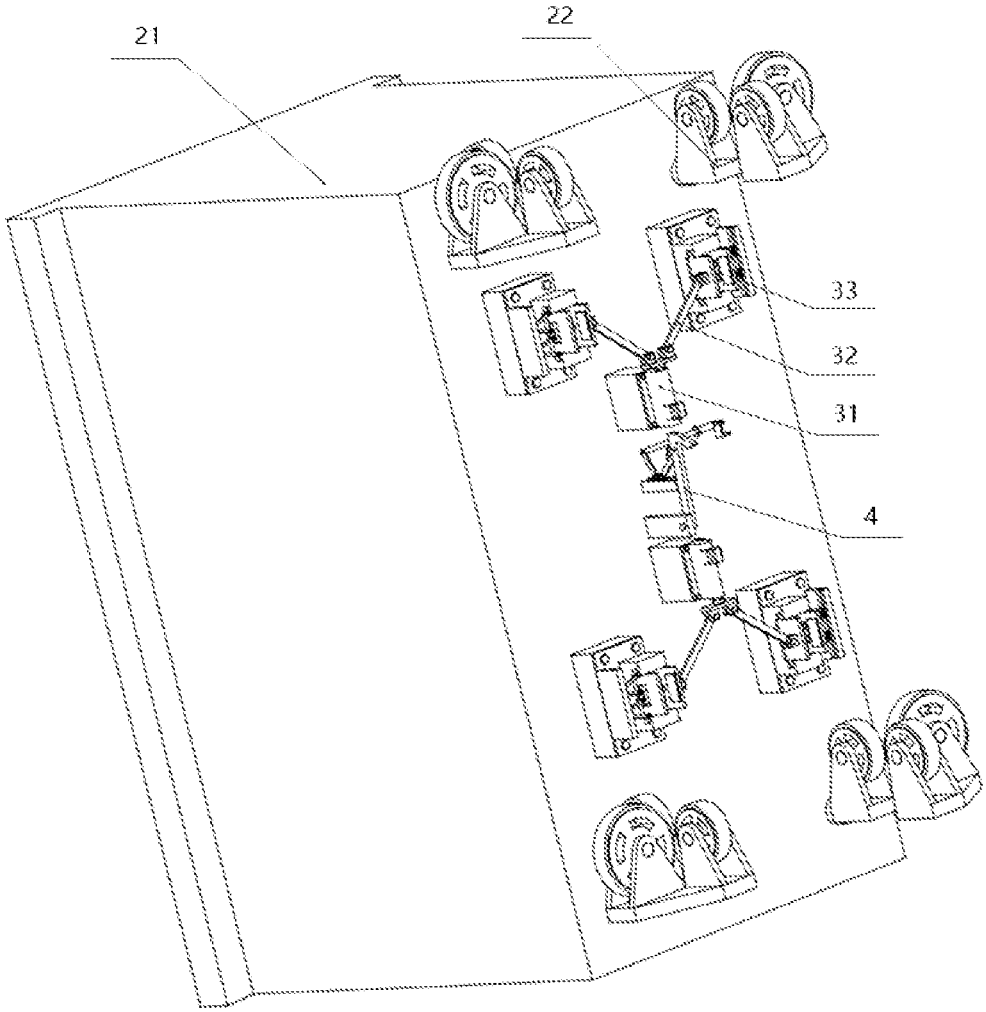
FIG. 8 is a schematic structural view of Embodiment 7 "brake mechanism".
Figure 9:
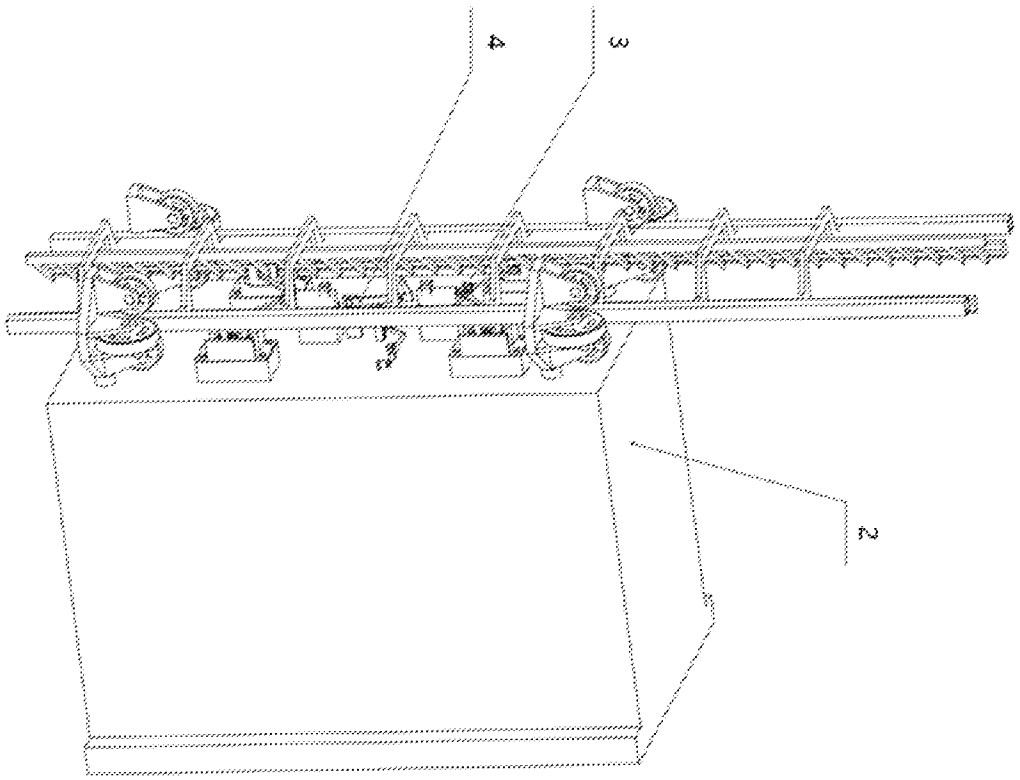
FIG. 9 is a working diagram of the brake mechanism in service according to Embodiment 7.
Figure 10:
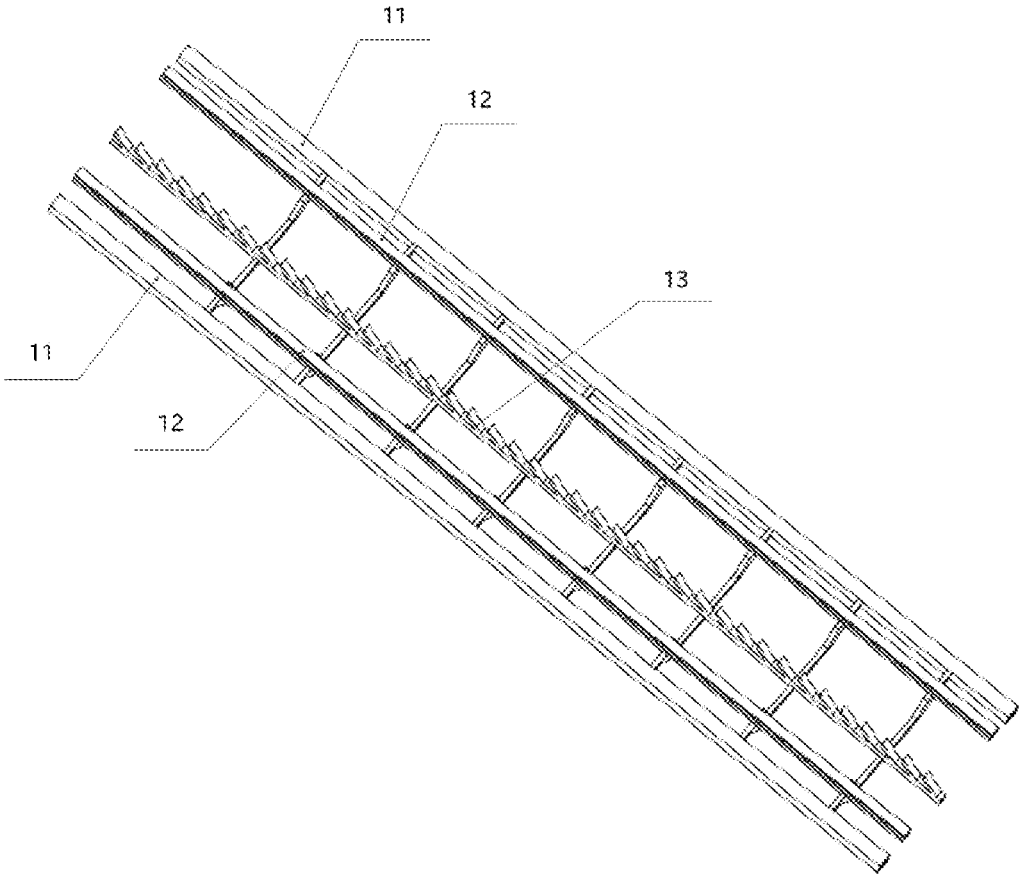
FIG. 10 is a schematic structural view of guide rail in Embodiment 7.

FIG. 8 through FIG. 10 illustrate the second embodiment of the brake mechanism for running system; the principal difference between the present embodiment and Embodiment 4: In the present embodiment, the running system is further provided with guide track 11, which can be separately arranged, be parallel to guide rail 1, or be the guide rail 1 itself. Guide track 11, braking rail 9 and skewed-tooth rail 13 are installed on several longitudinally arranged supporting beams that are fastened in the shaft.

In the present embodiment, the car is designed with four fixing bases, which are secured to the four corners of car 21, respectively. The fixing base is provided with three guide wheels 22, which fit to guide track 11 on guide rail 1, respectively to guarantee that car 21 never goes off the rail.

The brake mechanism of the present embodiment is applicable to existing elevator structures and multi-car elevator structures.

Guide rail 1 and the braking rail can be arranged on one side or different sides of the car. Where guide rail 1 and the braking rail are arranged at different sides of the car, the fixing base and guide rail 1 are at the same side.

Embodiment 8

Figure 13:
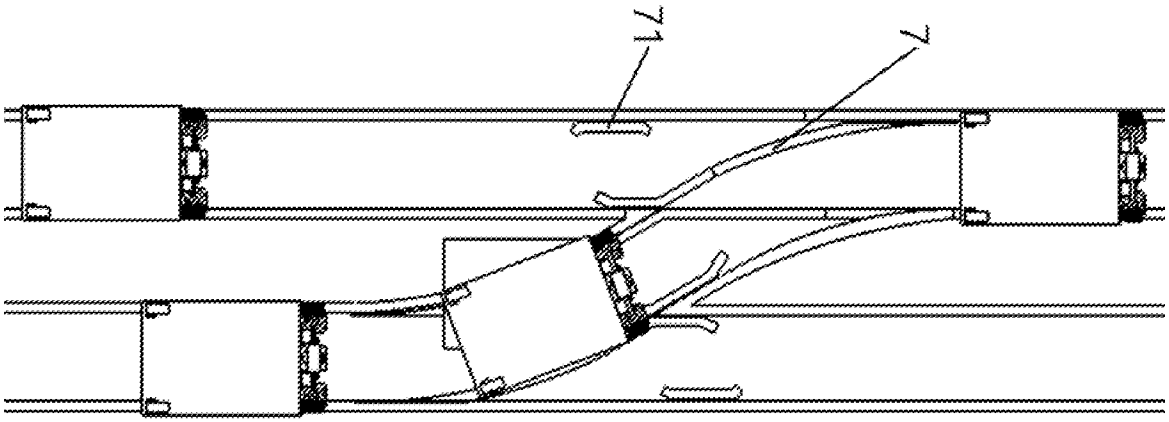
FIG. 13 is a operation diagram of multi-car elevator under the present invention.

FIG. 13 illustrate an embodiment used for the running system for multi-car elevator; the running system includes car 21, guide rail 1, the driving mechanism, and the switching mechanism; the running system may not be provided with the traction component, while the switching mechanism includes several rotating components and switching rail 7; each shaft is furnished with a set of guide rails 1. The structures of car 21, the driving mechanism and the guide rail are the same with that of Embodiment 1.

In the present embodiment, turnout 71 is a rotating component and arranged in each shaft; switching rail 7 is connected to or disconnected from guide rails 1 in both shafts through the rotation of turnout 71. The switching principle of turnout is identical with that of railway, so any equipment in prior art available for railway switching can be used in the switching mechanism of the present embodiment.

In the present embodiment, several cars of the elevator system run on guide rail 1 in parallel; when other cars slow down or stop in front of the car, the car goes to switching rail 7 and move on; the car is guided forward through the guide created by the contact between turnout 71 and guide rail 1; turnout 71 works with wheel flange 6 to forcibly switch the operation path of the car to different guide rails. The practical rail switching principle is similar to that of trains, so it's not described in detail here.

In the running system of the present embodiment, stand 24 progressively tilts during the rail switching for car; balancing apparatus 25 determines the tilt angle of car body 23, and transfers the data to processor 8; processor 8 controls the hydraulic part of position adjustment assembly so that the hydraulic cylinder of hydraulic part can extend or contract, thereby regulating the angular position of stand 24 with respect to car body 23, which enables the car to stay level all the time.

In the present embodiment, the running system is also designed with a brake mechanism that can be rail brake 12, or the brake mechanism of Embodiment 5 or 6; the brake mechanism is installed on stand 24.

The foregoing are only embodiments, which are not intended to limit the scoping. Moreover, as the contents disclosed herein should be readily understood and can be implemented by a person skilled in the art, all equivalent changes or modifications which do not depart from the concept hould be encompassed by the appended claims.

What is claimed is:

1. A running system for elevators, the running system includes car, guide rail, and driving mechanism, and wherein the car moves on the guide rail through the driving mechanism, friction is generated between the driving mechanism and the guide rail, and the friction is the driving force for the car, the driving mechanism is furnished with a climbing module, the climbing module clings to the guide rail, and the car runs on the guide rail through the climbing module;

wherein the running system is furnished with a brake mechanism, by means of which, the car stops moving or slows down;

wherein the brake mechanism is equipped with at least one set of brake devices, which are mounted on the car; the brake device clamps the guide rail during operation; when the car functions properly, the brake device is not in contact with the braking rail;

wherein the brake mechanism is equipped with at least one set of self-lock devices, which are mounted on the car; where the brake device malfunctions or the car does not move, the self-lock device locks on the braking rail;

wherein the braking rail is furnished with at least one lock piece, which is connected with the self-lock device when the self-lock device is in use.

2. The running system for elevator described of claim 1, wherein the climbing module includes pressure assembly and at least one set of attaching assemblies, the attaching assemblies move on the guide rail, and the attaching assemblies are pressed against the guide rail by means of the pressure assembly.

3. The running system for elevator described of claim 2, wherein the friction generated between the attaching assembly and the guide rail makes the car run.

4. The running system for elevator described of claim 3, wherein the attaching assemblies roll on the guide rail.

5. The running system for elevator described of claim 3, wherein the attaching assemblies are furnished with round rolling component.

6. The running system for elevator described of claim 5, wherein the attaching assemblies are provided with tires.

7. The running system for elevator described of claim 6, wherein the pressure applied by the pressure assembly to the attaching assembly is not less than F/f, where F represents the friction between attaching assembly and guide rail and where f is a friction coefficient between the guide rail and attaching assembly greater than 0.4.

8. The running system for elevator described of claim 3, wherein the attaching assemblies are provided with non-circular parts for rolling on the guide rail.

9. The running system for elevator described of claim 8, wherein the attaching assemblies are equipped with crawlers.

10. The running system for elevator described of claim 3, wherein the attaching assemblies move on the guide rail, and the friction coefficient f between the guide rail and attaching assembly is greater than 0.4.

11. The running system for elevator described of claim 1, wherein the running system is designed with a braking rail, which is the guide rail itself; or alternatively, the braking rail is separately arranged and does not intersect with the guide rail.

12. The running system for elevator described of claim 1, wherein the brake device is designed with a clamping component, which releases the braking rail when the car functions properly, and clamps the braking rail when the brake device works.

13. The running system for elevator described of claim 1, wherein the driving mechanism is furnished with a position adjustment assembly for regulating the car balance.

14. A running system for multi-car elevator, wherein the running system is equipped with a number of cars and at least two sets of guide rails, and that each set of the guide rails are used for car movement; the running system is provided with at least one switching mechanism and driving mechanism described in claim 1; the car moves on the guide rail through the driving mechanism, and the guide rails are linked up via the switching mechanism; the guide rails of the car are changed through the switching mechanism.

15. The running system for multi-car elevator described of claim 14, wherein the running system is furnished with the brake mechanism, by means of which, the car stops moving or slows down.

16. The multi-car elevator running system described of claim 14, wherein the switching mechanism includes rotating component and switching rail; the switching rail is connected to or disconnected from the two guide rails through the rotation of the rotating component.

* * * * *